US005667928A

United States Patent [19]

Thomas et al.

[11] Patent Number: 5,667,928

[45] Date of Patent: Sep. 16, 1997

[54] DIP COATING METHOD HAVING INTERMEDIATE BEAD DRYING STEP

[75] Inventors: Mark S. Thomas, Williamson; Ronald E. Fox, Penn Yan; Mark C. Petropoulos, Ontario; Stanley J. Pietrzykowski, Jr., Rochester, all of N.Y.

[73] Assignee: Xerox Corporation, Stamford, Conn.

[21] Appl. No.: 659,552

[22] Filed: Jun. 6, 1996

[51] Int. Cl.[6] ..... G03G 5/00

[52] U.S. Cl. ..... 430/134; 430/133; 427/430.1; 427/105; 427/378

[58] Field of Search ..... 430/134, 133; 427/430.1, 105, 378, DIG. 12

[56] References Cited

U.S. PATENT DOCUMENTS

| | | | |
|---|---|---|---|
| 4,421,838 | 12/1983 | Takeda et al. | 430/58 |
| 4,610,942 | 9/1986 | Yashiki et al. | 430/58 |
| 5,120,627 | 6/1992 | Nozomi et al. | 430/59 |
| 5,213,937 | 5/1993 | Miyake | 430/130 |
| 5,279,916 | 1/1994 | Sumino et al. | 430/134 |
| 5,334,246 | 8/1994 | Pietrzykowski, Jr. et al. | 118/69 |

FOREIGN PATENT DOCUMENTS

| | | | |
|---|---|---|---|
| 1254848 | 11/1971 | United Kingdom | 427/378 |

*Primary Examiner*—Christopher D. Rodee
*Assistant Examiner*—Cheryl Juska
*Attorney, Agent, or Firm*—Zosan S. Soong

[57] ABSTRACT

A method is disclosed including: (a) dip coating a batch of substrates, each substrate defining an end region, a center region, and a top region, with a first coating solution including a solvent to deposit a first layer on the end region, the center region, and optionally on a part of the top region of each substrate, wherein the first layer includes a wet coating solution bead formed at the end region of each substrate, thereby resulting in a plurality of wet coating solution beads; (b) directing a gas simultaneously at the entire plurality of the wet coating solution beads to remove a portion of the solvent in each bead, wherein the gas fails to disrupt the coating uniformity of the part of the first layer over the center region of each substrate; and (c) dip coating the batch of the substrates subsequent to (b) with a second coating solution to deposit a second layer over the first layer, wherein the portion of the solvent removed from each bead in (b) is sufficient to prevent contamination of the second coating solution by the first layer.

12 Claims, 2 Drawing Sheets

FIG. 2
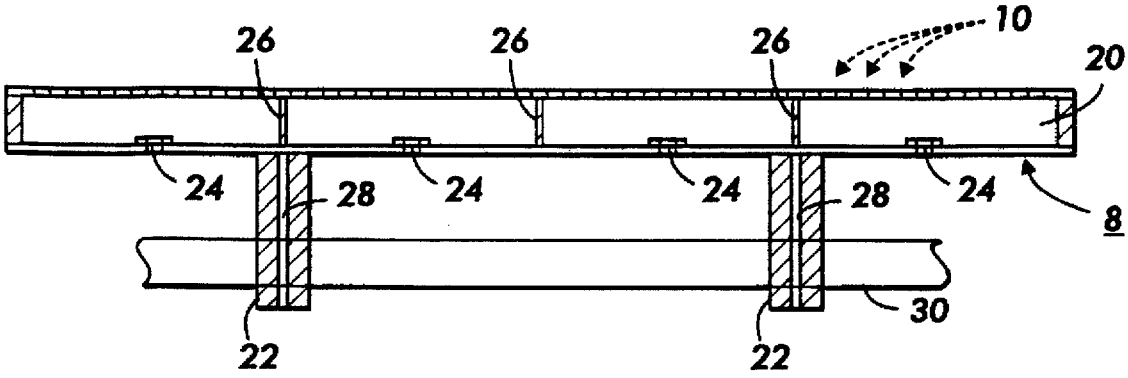
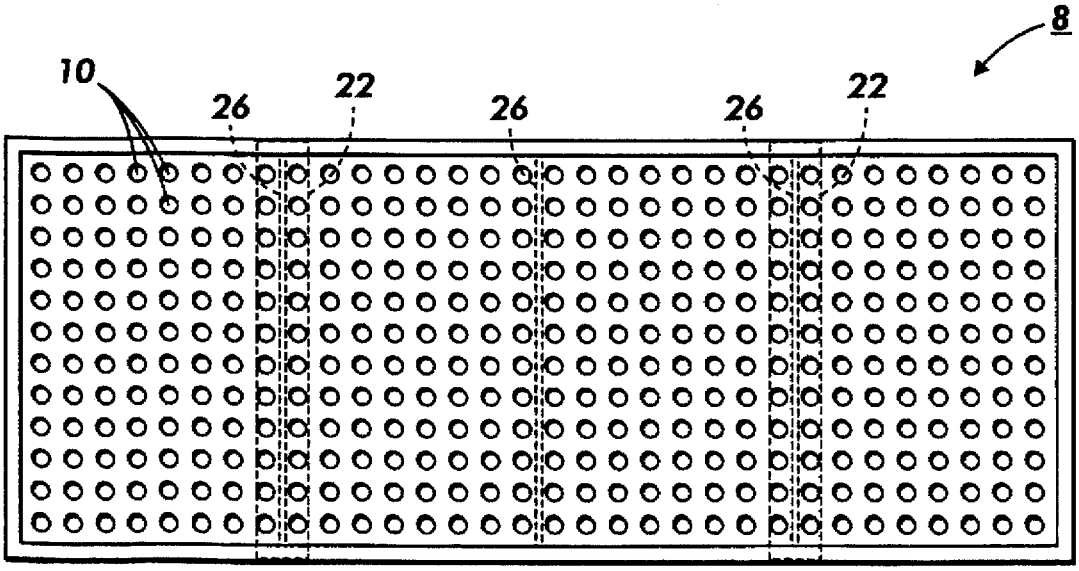
FIG. 3

DIP COATING METHOD HAVING INTERMEDIATE BEAD DRYING STEP

BACKGROUND OF THE INVENTION

This invention relates to a dip coating method, for use in fabricating for instance photosensitive members, wherein coating beads are subjected to partial drying to prevent contamination of the coating solution in the next dip coating vessel. The term bead refers to a coating buildup such as an excessively thick portion of the coating on the substrate.

Dip coating is a coating method typically involving dipping a substrate in a coating solution and taking up the substrate. In dip coating, the coating thickness depends on the concentration of the coating material and the take-up speed, i.e., the speed of the substrate being lifted from the surface of the coating solution. It is known that the coating thickness generally increases with the coating material concentration and with the take-up speed. A bead may be formed during dip coating on the bottom end region of the substrate, especially at the bottom edge, where the bead covers a portion of the outer and inner surface of the bottom end region. The bead can be quite large such as from about 100 to 250 microns in thickness (measured from the substrate surface) and from about 3 to 10 mm in width (measured along the length of the substrate). It has been found that the time required for ambient conditions to partially dry the bead to a tacky film, which is then sufficiently dry for the next coating solution without danger of contaminating that coating solution, may be in excess of about 90 minutes. Such a long time period may be needed because the bead is generally much thicker than the rest of the coated layer and because ambient air cannot freely circulate within the substrate interior to evaporate solvent from the portion of the wet coating solution bead on the inside surface of the substrate. This is a problem since there may be less than 90 minutes between dip coating cycles in certain production processes and thus the insufficiently dry bead will contaminate the coating solution in the next dip coating vessel. Consequently, there is a need, which the present invention addresses, for a coating method which decreases the time required to evaporate a sufficient amount of the solvent from a wet coating to avoid contaminating the coating solution in the next dip coating vessel.

The following documents disclose conventional dip coating methods, dip coating apparatus, and photosensitive members:

Miyake, U.S. Pat. No. 5,213,937, discloses a process for preparing an electrophotographic photoreceptor;

Takeda et al., U.S. Pat. No. 4,421,838, discloses processes for preparing photoconductive elements and electrophotosensitive materials;

Yashiki et al., U.S. Pat. No. 4,610,942, discloses an electrophotographic member having corresponding thin end portions of charge generation and charge transport layers;

Nozomi et al., U.S. Pat. No. 5,120,627, discloses an electrophotographic photoreceptor having a dip coated charge transport layer; and Sumino et al., U.S. Pat. No. 5,279,916, discloses a process for producing an electrophotographic photosensitive member.

SUMMARY OF THE INVENTION

The present invention is accomplished in embodiments by providing a coating method comprising:

(a) dip coating a batch of substrates, each substrate defining an end region, a center region, and a top region, with a first coating solution including a solvent to deposit a first layer on the end region, the center region, and optionally on a part of the top region of each substrate, wherein the first layer includes a wet coating solution bead formed at the end region of each substrate, thereby resulting in a plurality of wet coating solution beads;

(b) directing a gas simultaneously at the entire plurality of the wet coating solution beads to remove a portion of the solvent in each bead, wherein the gas fails to disrupt the coating uniformity of the part of the first layer over the center region of each substrate; and (c) dip coating the batch of the substrates subsequent to (b) with a second coating solution to deposit a second layer over the first layer, wherein the portion of the solvent removed from each bead in (b) is sufficient to prevent contamination of the second coating solution by the first layer.

In embodiments, the substrates have an endless, hollow configuration with the end region being open, and (b) comprises positioning the batch of the substrates over a gas channelling structure and directing the gas through the structure simultaneously at the entire plurality of the wet coating solution beads, wherein the gas also enters into the substrate interior.

In other embodiments of the present invention, the substrates have an endless, hollow configuration with the end region being open, and (b) comprises positioning the batch of the substrates over a gas channelling structure which includes a table member, wherein the table member defines a plurality of holes, and directing the gas through the holes in the table member simultaneously at the entire plurality of the wet coating solution beads, wherein the gas also enters into the substrate interior.

BRIEF DESCRIPTION OF THE DRAWINGS

Other aspects of the present invention will become apparent as the following description proceeds and upon reference to the Figures which represent preferred embodiments:

FIG. 2 represents a schematic, cross-sectional side view of the gas channelling structure; and FIG. 3 represents a schematic, top view of the gas channelling structure of FIG. 2.

Unless otherwise noted, the same reference numeral in different Figures refers to the same or similar feature.

DETAILED DESCRIPTION

Figure 1:
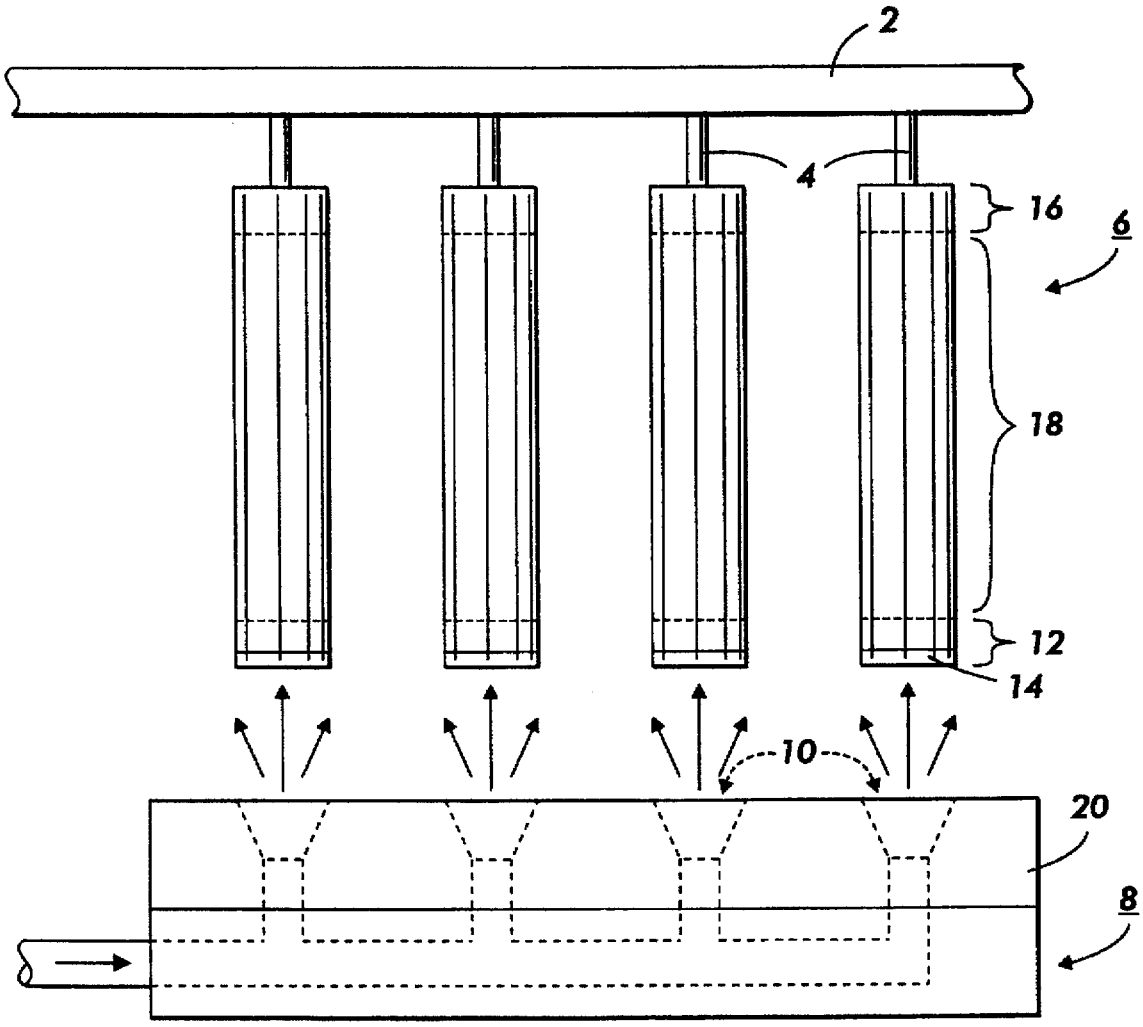
FIG. 1 represents a schematic, side view of the substrates being positioned over the gas channelling structure.

The present invention encompasses the following dip coating techniques to deposit layered material onto the substrates: moving the substrates into and out of the solution; raising and lowering the coating vessel to contact the solution with the substrates; and while the substrates are positioned in the coating vessel filling the vessel with the solution and then draining the solution from the vessel. The substrates may be moved into and out of the solution at any suitable speed including the take-up speed indicated in Yashiki et al., U.S. Pat. No. 4,610,942, the disclosure of which is hereby totally incorporated by reference. The dipping speed may range for example from about 50 to about 1500 mm/min and may be a constant or changing value. The take-up speed during the raising of the substrate may range for example from about 50 to about 500 mm/min and may be a constant or changing value. Preferably, all the substrates in the batch are dip coated substantially simultaneously, preferably simultaneously, in each coating solution. A preferred equipment to control the speed of the substrates during dip coating is available from Allen-Bradley Corporation and involves a programmable logic controller with an intelligent motion controller.

With the exception of the wet coating solution bead, the thickness of the wet coated layer on the substrate may be relatively uniform and may be for example from about 10 to about 40 microns in thickness. As discussed earlier, the wet coating solution bead may have a thickness ranging for example from about 100 to about 250 microns (measured from the substrate surface) and a width ranging for instance from about 3 to about 10 mm.

The substrates may be employed in the fabrication of photosensitive members wherein each substrate preferably has a hollow, endless configuration and defines a top region (a non-imaging area), a center region (an imaging area), and an end region (a non-imaging area). The precise dimensions of these three substrate regions vary in embodiments. As illustrative dimensions, the top region ranges in length from about 10 to about 50 mm, and preferably from about 20 to about 40 mm. The center region may range in length from about 200 to about 400 mm, and preferably from about 250 to about 300 mm. The end region may range in length from about 10 to about 50 mm, and preferably from about 20 to about 40 mm.

Any suitable chuck assembly can be used to hold the substrates including the chuck assemblies disclosed in Mistrater et al., U.S. Pat. No. 5,320,364, and Swain et al., U.S. application Ser. No. 08/395,214 (D/94641), the disclosures of which are hereby totally incorporated by reference. A chucking assembly engages the top end of each substrate and lowers the end region, the center region, and optionally a part of the top region into the coating solution.

The substrate batch size may range for example from about 5 to about 400 substrates, preferably from about 100 to about 300 substrates. In certain embodiments, the batch size is at least about 8 substrates. The spacing between substrate peripheries (based on the closest distance between the outer surfaces of adjacent substrates) can be from about 20 mm to about 200 mm, preferably from about 30 mm to about 150 mm, and more preferably from about 30 mm to about 100 mm. The batch of substrates may be dip coated in a single coating vessel wherein there are absent vessel walls defining a separate compartment for each of the substrates. A dip coating apparatus employing a single bathtub tank is illustrated in Mark C. Petropoulos et al., U.S. Ser. No. 08/609,368 (D/94640), filed Mar. 1, 1996, the disclosure of which is hereby totally incorporated by reference. In embodiments of the present invention, there may be an individual coating vessel for each substrate.

FIG. 1 illustrates a preferred apparatus to evaporate solvent from the wet coating solution bead on each substrate between dip coating steps to avoid contamination of the next coating solution from an insufficiently dry bead. Carrier pallet 2 and the coupled chuck assemblies 4 vertically position the batch of substrates 6 over the gas channelling structure 8 which in embodiments may include a table member 20 defining a plurality of holes 10. The holes may be "V"-shaped to spread the gas flow over a wider area. The end region 12 of each substrate may be disposed at a distance ranging for example from about 1 cm to about 10 cm, preferably from about 2 cm to about 5 cm, from the surface of the gas channelling structure 8. The top region 16 and center region 18 of the substrates are indicated. The wet coating solution bead 14 covers a portion of the outer and inner surface of the end region 12 on each substrate. Preferably, the end region 12 of each substrate 6 is positioned over a single hole 10. The number of holes may match the number of substrates. The number of holes may range in number from about 5 to about 400, preferably from about 100 to about 300, wherein the holes may be arranged in columns and rows. Each hole may range in diameter from about 5 mm to about 20 mm, and preferably from about 7 mm to about 15 mm. In alternate embodiments, separate gas nozzles may be incorporated in the gas channelling structure instead of the holes. The gas channelling structure is coupled to a gas pump (not shown).

Gas is simultaneously directed at the entire plurality of the wet coating solution beads at a gentle gas pressure ranging for example from 2 psi to about 15 psi, preferably from about 5 psi to about 8 psi, where the gas pressure is selected so as to avoid disrupting the coating uniformity of the coated layer over the center region of each substrate. The gas flow ranges for example from about 50 to about 500 cubic feet per hour, and preferably from about 100 to about 200 cubic feet per hour. It is preferred that gas flow meters are hooked inline between the gas source and the gas channelling structure 8 to control the gas flow. The gas is also directed into the substrate interior to assist in evaporation of solvent from any wet coating solution layer therein. The gas applied to each substrate end region can be in the form of one, two, or more gas jets or streams. The gas may be directed continuously and simultaneously at the entire plurality of the wet coating solution beads for a time ranging for example from about 1 to about 20 minutes, preferably from about 5 to about 10 minutes, wherein it may be desired in certain embodiments that each wet coating solution bead receives the same volume of the gas in the same length of time. The gas may be for example air or nitrogen.

Between dip coating steps, a part of the solvent from the wet coated layer over the center region and over the top region of each substrate may be removed by exposure to ambient air (i.e., evaporation process) for a period of time ranging for example from about 1 to about 20 minutes, preferably from about 5 to about 10 minutes. This exposure to ambient air may occur at the same time as the end region is subjected to the gas treatment. Ambient air generally is sufficient for the wet coated layer over the center region and the top region since it is relatively thin as compared with the bead thickness.

The coated layer, including the coating solution bead subjected to gas, is sufficiently dry with no fear of contamination of the next coating solution when gentle rubbing with a finger or cloth fails to remove any of the coated layer. In certain embodiments, the time required using the present invention to remove a sufficient amount of the solvent from the wet coating solution bead to avoid contamination of the coating solution in the next dip coating vessel is reduced to a drying time of less than about 10 minutes as compared with a drying time greater than about 90 minutes when relying solely on ambient conditions (e.g., ambient air). The present invention may be used between any two dip coating steps such as for example between the coating of the undercoat layer (which may be a charge barrier layer) and the charge generating layer, or between the coating of the charge generating layer and the charge transport layer.

FIGS. 2–3 represent more detailed views of the gas channelling structure 8 which includes a hollow table member 20 and support legs 22. The upper surface of the table member 20 defines a plurality of the holes 10 which is in communication with the interior of the table member. A plurality of gas feed mounting blocks 24 enables separate gas inflow tubes (not shown) to be hooked up to different sections of the table member 20. Baffle plates 26 are mounted within the table member 20 to segregate the gas flows. The combination of the baffle plates 26 and the separate gas inflow tubes may ensure that every substrate receives the same volume of the gas regardless where a particular substrate is positioned over the table member, even for a large batch. In each support leg 22, there may be a slot 28 for adjusting the height of the table member 20 in relation to the bottom of the substrates. In addition, a frame 30 may lock the gas channelling structure 8 into position with respect to the adjacent coating vessels (not shown).

The substrate can be formulated entirely of an electrically conductive material, or it can be an insulating material having an electrically conductive surface. The substrate can be opaque or substantially transparent and can comprise numerous suitable materials having the desired mechanical properties. The entire substrate can comprise the same material as that in the electrically conductive surface or the electrically conductive surface can merely be a coating on the substrate. Any suitable electrically conductive material can be employed. Typical electrically conductive materials include metals like copper, brass, nickel, zinc, chromium, stainless steel; and conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoconductive member. Generally, the conductive layer ranges in thickness from about 50 Angstroms to about 30 microns, although the thickness can be outside of this range. When a flexible electrophotographic imaging member is desired, the substrate thickness typically is from about 0.015 mm to about 0.15 mm. The substrate can be fabricated from any other conventional material, including organic and inorganic materials. Typical substrate materials include insulating non-conducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®. The coated or uncoated substrate can be flexible or rigid, and can have any number of configurations such as a cylindrical drum, an endless flexible belt, and the like. The substrates preferably have a hollow, endless configuration.

Each coating solution may comprise materials typically used for any layer of a photosensitive member including such layers as a subbing layer, a charge barrier layer, an adhesive layer, a charge transport layer, and a charge generating layer, such materials and amounts thereof being illustrated for instance in U.S. Pat. No. 4,265,990, U.S. Pat. No. 4,390,611, U.S. Pat. No. 4,551,404, U.S. Pat. No. 4,588,667, U.S. Pat. No. 4,596,754, and U.S. Pat. No. 4,797,337, the disclosures of which are totally incorporated by reference.

In embodiments, a coating solution may include the materials for a charge barrier layer including for example polymers such as polyvinylbutyral, epoxy resins, polyesters, polysiloxanes, polyamides, or polyurethanes. Materials for the charge barrier layer are disclosed in U.S. Pat. No. 5,244,762 and 4,988,597, the disclosures of which are totally incorporated by reference.

In embodiments, a coating solution may be formed by dispersing a charge generating material selected from azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlorophthalocyanine, and the like; quinacridone pigments; or azulene compounds in a binder resin such as polyester, polystyrene, polyvinyl butyral, polyvinyl pyrrolidone, methyl cellulose, polyacrylates, cellulose esters, and the like. A representative charge generating layer coating solution comprises: 2% by weight hydroxy gallium phthalocyanine; 1% by weight terpolymer of vinyl acetate, vinyl chloride, and maleic acid; and 97% by weight cyclohexanone.

In embodiments, a coating solution may be formed by dissolving a charge transport material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and the like, and hydrazone compounds in a resin having a film-forming property. Such resins may include polycarbonate, polymethacrylates, polyarylate, polystyrene, polyester, polysulfone, styrene-acrylonitrile copolymer, styrene-methyl methacrylate copolymer, and the like. An illustrative charge transport layer coating solution has the following composition: 10% by weight N,N'-diphenyl-N,N'-bis(3-methylphenyl)-[1,1'-biphenyl]-4,4'diamine, 14% by weight poly(4,4'-diphenyl-1,1'-cyclohexane carbonate (400 molecular weight); 57% by weight tetrahydrofuran; and 19% by weight monochlorobenzene.

A coating solution may also contain a solvent, preferably an organic solvent, such as one or more of the following: tetrahydrofuran, monochlorobenzene, and cyclohexanone.

After all the desired layers are coated onto the substrates, they may be subjected to elevated drying temperatures such as from about 100° to about 160° C. for about 0.2 to about 2 hours.

Other modifications of the present invention may occur to those skilled in the art based upon a reading of the present disclosure and these modifications are intended to be included within the scope of the present invention.

We claim:

1. A coating method comprising:

(a) dip coating a batch of endless, hollow substrates, each substrate defining an open end region, a center region, and a top region, with a first coating solution including a solvent to deposit a first layer on the end region, the center region, and optionally on a part of the top region of each substrate, wherein the first layer includes a wet coating solution bead formed at the end region of each substrate, thereby resulting in a plurality of wet coating solution beads;

(b) directing a gas simultaneously at the entire plurality of the wet coating solution beads to remove a portion of the solvent in each bead, wherein the gas fails to disrupt the coating uniformity of the part of the first layer over the center region of each substrate, wherein (b) comprises positioning the batch of the substrates over a gas channelling structure and directing the gas through the structure simultaneously at the entire plurality of the wet coating solution beads, wherein the gas also enters into the substrate interior; and (c) dip coating the batch of the substrates subsequent to (b) with a second coating solution to deposit a second layer over the first layer, wherein the portion of the solvent removed from each bead in (b) is sufficient to prevent contamination of the second coating solution by the first layer.

2. The coating method of claim 1, wherein the gas is air.

3. The coating method of claim 1, wherein (b) comprises positioning the batch of the substrates over the gas channelling structure which includes a table member, wherein the table member defines a plurality of holes, and directing the gas through the holes in the table member simultaneously at the entire plurality of the wet coating solution beads.

4. The coating method of claim 3, wherein the end region of each substrate is positioned over a single hole of the table member.

5. The coating method of claim 3, wherein the plurality of the holes ranges in number from about 5 to about 400.

6. The coating method of claim 1, wherein (b) comprises directing the gas continuously and simultaneously at the entire plurality of the wet coating solution beads for a period of time ranging from about 1 to about 20 minutes.

7. The coating method of claim 1, wherein during (b) each wet coating solution bead receives the same volume of the gas for the same length of time.

8. The coating method of claim 1, wherein the batch of the substrates ranges in number from about 5 to about 400.

9. The coating method of claim 1, wherein the first coating solution or the second coating solution includes a charge generating material.

10. The coating method of claim 1, wherein the first coating solution or the second coating solution includes a charge transport material.

11. The coating method of claim 1, wherein the batch of the substrates is dip coated simultaneously in (a) and (c).

12. The coating method of claim 1, further comprising allowing ambient air to remove a portion of the solvent from the part of the first layer over the center region of each substrate in the time between (a) and (c).

* * * * *